US008387904B2

(12) United States Patent
Schiffer et al.

(10) Patent No.: US 8,387,904 B2
(45) Date of Patent: Mar. 5, 2013

(54) SCREEN DEVICE AND FASTENING MEANS FOR SCREEN PLATES

(75) Inventors: Peter Schiffer, Millstatt (AT); Mario Fritz, Millstatt (AT); Egon Tiefnig, Sachsenburg (AT)

(73) Assignee: Manuel Lindner, Spittal/Drau (AT)

( * ) Notice: Subject to any disclaimer, the term of this patent is extended or adjusted under 35 U.S.C. 154(b) by 283 days.

(21) Appl. No.: 12/741,949

(22) PCT Filed: Nov. 17, 2008

(86) PCT No.: PCT/EP2008/009718

§ 371 (c)(1),
(2), (4) Date: Jun. 16, 2010

(87) PCT Pub. No.: WO2009/065544

PCT Pub. Date: May 28, 2009

(65) Prior Publication Data

US 2011/0186665 A1 Aug. 4, 2011

(30) Foreign Application Priority Data

Nov. 19, 2007 (EP) ..... 07022426

(51) Int. Cl.
*B02C 18/22* (2006.01)

(52) U.S. Cl. ..... 241/73; 29/428; 241/242

(58) Field of Classification Search ..... 241/73, 241/189.1, 242, 243; 29/428
See application file for complete search history.

(56) References Cited

U.S. PATENT DOCUMENTS

| | | | | |
|---|---|---|---|---|
| 2,225,781 | A | | 12/1940 | Hinerfeld |
| 4,318,512 | A | * | 3/1982 | Jacobson et al. ..... 241/73 |
| 4,824,034 | A | | 4/1989 | Baker |
| 5,485,924 | A | | 1/1996 | Zaun |
| 5,605,291 | A | | 2/1997 | Doskocil |

FOREIGN PATENT DOCUMENTS

DE 4100080 A1 7/1992

* cited by examiner

*Primary Examiner* — Mark Rosenbaum
(74) *Attorney, Agent, or Firm* — IP Strategies

(57) ABSTRACT

The present invention relates to fastening means for fastening a screen plate onto a screen carrier of a screen device for a comminuting device, comprising a first tensioning element, which is connected to the screen device, particularly to the screen carrier, and which is designed to exert a force on the screen plate; a second tensioning element, which is connected to the screen device, particularly the screen carrier, and which is designed to exert a force on the screen plate, wherein at least one of the tensioning elements is an elastic element, which is designed to exert an elastic restoring force on the screen plate such that the screen plate is tensioned between the first and the second tensioning elements. The invention further relates to a method for fastening a screen plate onto a screen carrier of a screen device for a comminuting device.

8 Claims, 1 Drawing Sheet

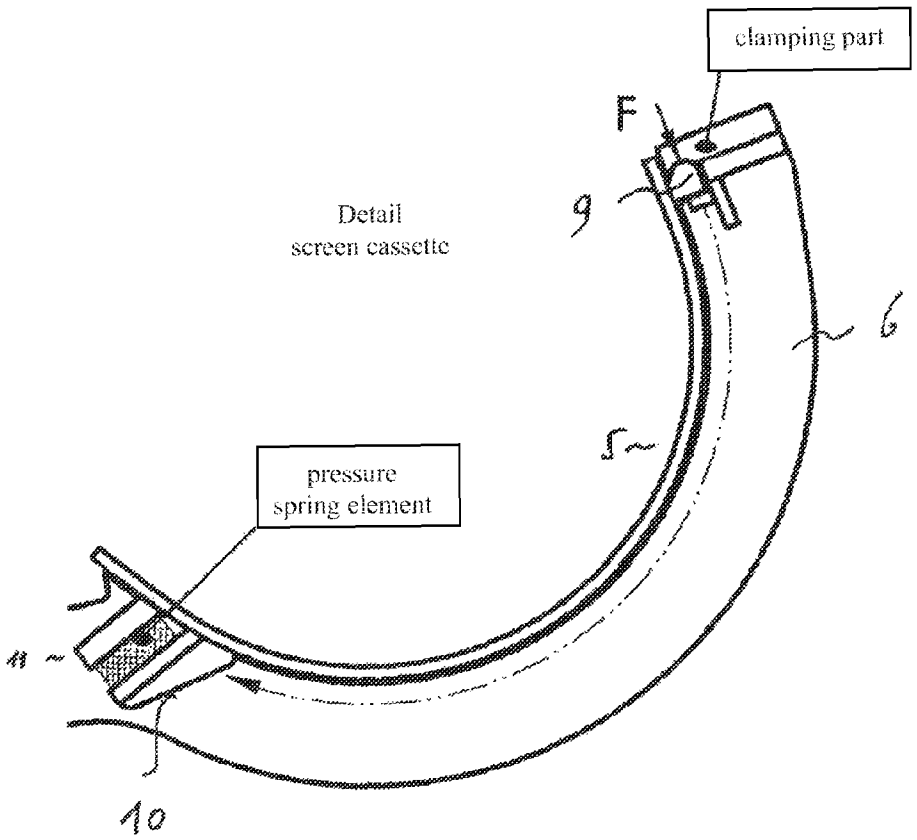
clamping part
F
9
6
5
Detail
screen cassette
pressure
spring element
11
10
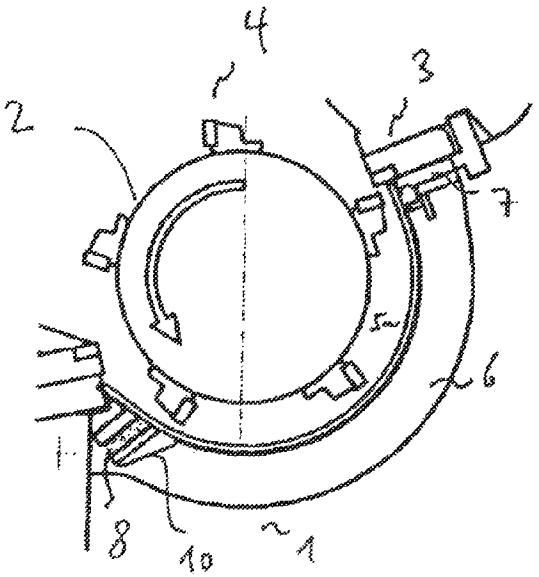
2
4
3
7
6
5
1
10
8

SCREEN DEVICE AND FASTENING MEANS FOR SCREEN PLATES

FIELD OF THE INVENTION

The present invention relates to a screen device for a comminuting device by means of which comminuted components are discharged, and in particular fastening means for fastening screen plates to screen cassettes.

BACKGROUND OF THE INVENTION

Commercial waste, industrial waste, domestic waste, etc., e.g. (hard) plastics, textiles, composites, wheels, rubber or scrap wood (such as pallets and particle boards) must be comminuted in corresponding comminuting devices before they are definitively disposed of or in particular before they are returned to the cycle of valuable substances.

A central element of a conventional comminutor is a rotor unit which comprises a rotor equipped with knives which can be provided e.g. with concavely ground circular cutting crowns. The knives are fastened to knife holders, for example by screwing, which are welded into knife recesses or can be screwed, for example, the recesses being milled into the rotor. The comminution of the loaded material is accomplished between the knives rotating together with the rotor and stationary bed knives (stator knives, wiper elements).

After comminution between the rotating knives and the stator knives, the material is discharged through a screen device. This screen device determines the comminution factor according to the mesh size (e.g. 5 to 150 mm). The comminuted material passed through the screen is conveyed further by means of a conveying belt, a spiral conveyor, a chain conveyor or an exhaust system. Typically, the screen device contains screen plates which are screwed at their ends to a screen carrier (a screen cassette) or to a machine housing. To securely fasten the screen plates to the screen carrier or the housing, inter alia a plurality of screws is required.

While the comminutor is operated, the screwed joints are subjected to high stresses, and thus, the bearing surfaces of the screwed surfaces must be as parallel as possible with respect to each other to prevent, if possible, the screwed joints from getting released or being broken, resulting in severe damages of the complete comminuting device in operation. The parallelism of the bearing surfaces of the screwed surfaces can only be achieved if the screen cassette and the screen plates are manufactured with very small tolerances. Thereby, the manufacture of these components is very expensive. Moreover, the tightening torques when the screen plates are connected with screws must be exactly observed, so that the assembly can be exclusively carried out by correspondingly qualified personnel.

A further disadvantage of the screwed fastening of the screen plates in prior art is that the screwed joints are sometimes very difficult to access. For example, some screwed joints can be accessed only e.g. by a serviceman descending to a discharge means underneath the comminutor which conveys the comminuted material passed through the screen plates. As the screen plates are subject to wear and thus must be maintained regularly, the possibly hardly accessible screwed joints must be released and replaced by a serviceman at regular intervals, which is very time-consuming.

As the downtime of the comminutor should be minimized for economic reasons, it is desirable to provide a fastening possibility for screen plates to a screen carrier of a screen device for a comminutor which permits a facilitated and quicker maintenance, in particular a facilitated removal of worn out screen plates and assembly of new screen plates.

BRIEF SUMMARY OF THE INVENTION

The above mentioned object is achieved by fastening means for fastening a screen plate to a screen carrier of a screen device for a comminuting device according to claim 1. The screen device in particular comprises the screen carrier and a number of screen plates. The fastening means comprises a first tensioning element which is connected to the screen device, in particular the screen carrier, and which is designed to exert a force on the screen plate;

a second tensioning element which is connected to the screen device, in particular the screen carrier, and which is designed to exert a force on the screen plate;

wherein at least one of the tensioning elements is an elastic element which is designed to exert an elastic restoring force on the screen plate.

The screen plate is thus fastened to the screen carrier without screws by the forces applied by the first and the second tensioning element. As at least one of the tensioning elements exerts an elastic restoring force (that means that it reacts to an applied force by exerting a reaction force), the claimed fastening means are advantageous in that the fastening of the screen plate (screen) is less susceptible to vibrations than in prior art, i.e. the fastening is more reliable.

Moreover, a screen plate fastened with the claimed fastening means can be easily and quite quickly replaced by a new one after it has worn down in the course of the operation of the comminuting device. Furthermore, the provision of an elastic tensioning element which exerts the elastic force (for example a spring restoring force) permits greater work tolerances of the individual components of the screen device, as variances in the manufacture can be compensated by correspondingly adjusting the elastic tensioning element (the elastic restoring force).

The first as well as the second tensioning element can exert a compressive force or a tensile force on the screen plate, i.e. the tensioning of the screen plate can be effected by pushing on opposite edges or pulling at the same. That means, the screen plate is either put under tensile stress or shearing stress.

The elastic tensioning element can be in particular a spring element or at least comprise one. The spring element can be a pressure spring, a leaf spring, a flat spiral spring or else a rubber element which are well-known in prior art. The use of such a spring element for applying the elastic restoring force for fastening the screen plate by tensioning is inexpensive, practicable and permits a reliable fastening of the screen plate to the screen carrier.

According to a further development, the mentioned first tensioning element is a mechanical clamping part which is designed to exert a force in parallel to an edge of the screen plate, and the second tensioning element is an elastic element, in particular a spring element, which is designed to exert an elastic restoring force in parallel to the edge of the screen plate as a reaction to the force exerted by the first tensioning element.

The clamping element can serve to clamp the screen plate at one end thereof to the screen carrier, and also to exert a force on this end of the screen plate which is essentially directed towards the opposite end of the screen plate. For example, a device for receiving the screen plate (a screen cassette) can be used as clamping element.

The screen device will be provided inter alia such that it surrounds the rotor of a comminuting device partially along the rotor axis. Principally, the tensioning of the screen plate can be effected by applying forces by the tensioning elements only in a direction along the longitudinal axis of the rotor, preferably, however, in a direction perpendicular to the longitudinal axis of the rotor, in particular in parallel to a narrow side of a square screen plate.

The present invention furthermore provides a screen device for a comminuting device comprising the above-described fastening means.

Moreover, a screen plate for a screen device for a comminuting device is provided, which comprises a first element designed to be engaged with a first tensioning element of the screen device, and which comprises a second element designed to be engaged with a second tensioning element of the screen device, such that the screen plate can be tensioned between the first and the second tensioning element. The first and the second element of the screen device can be embodied integrally with the same, and both elements can be provided in the form of protrusions, projections, grooves, ridges, etc.

Furthermore, engagement can here also only mean that the first (second) element of the screen plate is in contact with the first (second) tensioning element of the screen device, that means, that this element abuts the tensioning element.

The present invention furthermore provides a comminuting device for comminuting material components, comprising at least one rotor with rotor knives attached thereto;
at least one stator knife;
at least one screen device; and
the fastening means described above.

According to a further development, the comminuting device comprises, apart from the at least one rotor with rotor knives attached thereto and the at least one stator knife, at least one screen device comprising the above-described fastening means and/or the screen plate which comprises a first element which is designed to be engaged with ifirst tensioning element of the screen device, and which comprises a second element which is designed to be engaged with a second tensioning element of the screen device, such that the screen plate can be tensioned between the first and the second tensioning element.

The above mentioned object is also achieved by a method for fastening a screen plate to a screen carrier of a screen device for a comminuting device according to claim 4. The claimed method comprises the step of clamping the screen plate in or at the screen carrier between a first and a second tensioning element, such that at least one of the tensioning elements exerts an elastic restoring force on the screen plate. That means, the tensioning of the screen plate is effected by means of the elastic restoring force which at least one of the tensioning elements exerts. More precisely, this tensioning element has a restoring force as a reaction to a force acting on the same which is then applied to the screen plate.

In particular, the clamping of the screen plate can be effected such that the first tensioning element exerts a force in parallel to one edge of the screen plate, for example by a contact of the screen plate with the housing, and the second tensioning element exerts an elastic restoring force in parallel to the edge of the screen plate as a reaction to the force exerted by the first tensioning element.

According to an example of the method according to the invention, the screen plate is clamped with a finite bend in or at the finitely bent screen carrier such that the force of the first tensioning element and the force of the second tensioning element are exerted in parallel to the bent surface of the bent screen plate. That means, the screen carrier and thus the screen device can have an essentially ellipsoidal partial shape, for example the shape of a portion of a cylinder or a cylindrical shell or a sphere or a spherical shell, and thus have a finite bend. A force can in particular act from the first and/or second tensioning element along the bend and perpendicularly to the longitudinal axis of the rotor of a comminuting device partially surrounded by the screen device.

Further features and an exemplary embodiment of the present invention will be illustrated more in detail hereinafter with reference to the drawing. It will be understood that the embodiment does not end with the field of the present invention. It will be furthermore understood that some or all features described below can also be combined with each other in a different way.

BRIEF DESCRIPTION OF THE DRAWINGS

FIG. 1 is one example for a fastening means for a screen plate, wherein the fastening means comprises a clamping part and a pressure spring element.

DETAILED DESCRIPTION OF THE INVENTION

It should be mentioned first that the terms "screen plate" and "screen" are employed in this application as synonyms, and the term "screen plate" shall in particular not express any restriction of the material of the screen. Equally, the terms "screen cassette" and "screen carrier" are employed as synonyms, and the term "screen cassette" shall not express any geometric or other restriction with respect to the neutral term of the carrier.

As is shown in FIG. 1, a comminuting device shown in a section comprises a screen device 1 which partially surrounds a rotor 2 (rotating counterclockwise in the shown example). At the upper right end of the screen device 1, there is a stator knife 3 which comminutes loaded material in cooperation with the rotating knives 4 attached to the rotor 2. A screen plate 5 having a predetermined perforation (here, various shapes, such as a honeycomb shape, are possible) is fastened to a screen carrier 6 by means of a clamping part 7 and a pressure spring element 8. The screen device can comprise several screen plates, for example with a mesh size of 5 to 150 mm. It will be understood that in various embodiments a fixed or movable portion of the housing can assume the function of the clamping part 7.

As is shown on the right side of FIG. 1, the clamping part 7 exerts a force F on a protrusion or projection 9 which can be embodied integrally with the screen plate 5 or otherwise firmly connected to it. The clamping part 7 exerts a clockwise force F in the peripheral direction (circumferential direction) along the screen plate 5 via this protrusion 9.

The amount of the force can be adjusted by a person skilled in the art depending on the concrete application for a certain type of comminutor, e.g. by adjusting the screwing of the clamping part 7.

The screen plate 5 is pressed against a pressure spring element 8, e.g. a cold-coiled pressure spring of special steel, by the clamping part 7 via a further projection (a protrusion) 10 of the screen plate. In other embodiments, a rubber plate can replace the pressure spring of special steel. The spring body can be cylindrical, square, conical, double-conical, barrel-shaped, etc. Flat spiral springs and torsion as well as leg springs can be used.

A supporting projection 11 of the screen device 1, which is embodied e.g. at the screen cassette 6 (the screen carrier), receives the force F exerted by the clamping part 7 and transmitted by the pressure spring element 8. Thus, the screen plate is tensioned with a finite bend. It can be easily released by actuating the clamping part 7. Moreover, the fastening of the screen plate is relatively insensitive with respect to vibrations and similar stresses in operation by the provision of the pressure spring.

The fastening means according to the invention for fastening screen plates to screen cassettes can be advantageously also employed in single-shaft as well as in dual-shaft comminutors.

The invention claimed is:

1. Fastening means for fastening a screen plate to a screen carrier of a screen device for a comminuting device, comprising a first tensioning element, adapted to be connected to the screen device and to exert a force on the screen plate; and a second tensioning element, adapted to be connected to the screen device and to exert a force on the screen plate;

wherein at least one of the tensioning elements is an elastic element that is adapted to exert an elastic restoring force on the screen plate;

wherein the first tensioning element is a mechanical clamping part that is adapted to exert a force in parallel to an edge of the screen plate, and the second tensioning element is an elastic element that is adapted to exert an elastic restoring force in parallel to the edge of the screen plate as a reaction to the force exerted by the first tensioning element.

2. Fastening means according to claim 1, wherein the first and/or the second tensioning element comprises a spring element.

3. Screen device for a comminuting device,comprising:

a screen plate;

a screen carrier; and the fastening means according to claim 1.

4. Comminuting device or comminuting material components, comprising at least one rotor with rotor knives attached thereto;

at least one stator knife; and the screen device according to claim 3.

5. Comminuting device for comminuting material components, comprising at least one rotor with rotor knives attached thereto;

at least one stator knife;

at least one screen device; and the fastening means according to claim 1.

6. Method for fastening a screen plate to a screen carrier of a screen device for a comminuting device, comprising the step of clamping the screen plate in or at the screen carrier between a first tensioning element and a second tensioning element, such that at least one of the tensioning elements exerts an elastic restoring force on the screen plate;

wherein the clamping of the screen plate can be effected such that the first tensioning element exerts a force in parallel to one edge of the screen plate, and the second tensioning element exerts an elastic restoring force in parallel to the edge of the screen plate as a reaction to the force exerted by the first tensioning element.

7. Method according to claim 6, wherein the screen plate is clamped with a finite bend in or at the finitely bent screen carrier such that the force of the first tensioning element and the force of the second tensioning element is exerted in parallel to the bent surface of the bent screen plate.

8. Method according to claim 6, wherein the screen plate is clamped with a finite bend in or at the finitely bent screen carrier such that the force of the first tensioning element and the force of the second tensioning element is exerted in parallel to the bent surface of the bent screen plate.

* * * * *

UNITED STATES PATENT AND TRADEMARK OFFICE
Certificate

Patent No. 8,387,904 B2 Patented: March 5, 2013

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Peter Schiffer, Millstatt (AT); Mario Fritz, Millstatt (AT); Egon Tiefnig, Sachsenburg (AT); and Manuel Lindner, Spittal/Drau (AT).

Signed and Sealed this Fourteenth Day of January 2014.

SHELLY SELF
*Supervisory Patent Examiner*
Art Unit 3725
Technology Center 3700